US009679690B2

(12) United States Patent
Nila et al.

(10) Patent No.: US 9,679,690 B2
(45) Date of Patent: Jun. 13, 2017

(54) SOLENOID WITH AN OVER-MOLDED COMPONENT

(71) Applicants: Norgren GmbH, Alpen (DE); Norgren GT Development Corporation, Auburn, WA (US)

(72) Inventors: Vasile Nila, Fellbach (DE); Gerhard Uiselt, Weinstadt (DE); John Michael Morris, Auburn, WA (US)

(73) Assignees: Norgren GmbH, Alpen (DE); Norgren GT Development Corporation, Auburn, WA (US)

( * ) Notice: Subject to any disclaimer, the term of this patent is extended or adjusted under 35 U.S.C. 154(b) by 0 days.

(21) Appl. No.: 14/354,662

(22) PCT Filed: Oct. 25, 2012

(86) PCT No.: PCT/EP2012/004459

§ 371 (c)(1),
(2) Date: Apr. 28, 2014

(87) PCT Pub. No.: WO2013/064226

PCT Pub. Date: May 10, 2013

(65) Prior Publication Data

US 2014/0333398 A1 Nov. 13, 2014

Related U.S. Application Data

(60) Provisional application No. 61/554,192, filed on Nov. 1, 2011.

(51) Int. Cl.

| | |
|---|---|
| ***H01F 3/00*** | (2006.01) |
| ***H01F 7/121*** | (2006.01) |
| ***H01F 7/127*** | (2006.01) |
| ***H01F 7/128*** | (2006.01) |
| ***H01F 7/16*** | (2006.01) |

(52) U.S. Cl.

CPC ..... *H01F 7/121* (2013.01); *H01F 7/127* (2013.01); *H01F 7/128* (2013.01); *H01F 7/1607* (2013.01); *Y10T 29/4902* (2015.01)

(58) Field of Classification Search

CPC ... H01H 2050/166; H01F 7/121; H01F 7/129; H01F 7/16; H01F 7/1607

USPC ..... 335/281

See application file for complete search history.

(56) References Cited

U.S. PATENT DOCUMENTS

| | | | | |
|---|---|---|---|---|
| 4,568,021 | A * | 2/1986 | Deckard et al. | 239/88 |
| 5,261,637 | A * | 11/1993 | Curnow | 251/129.15 |
| 5,752,689 | A * | 5/1998 | Barkhimer et al. | 251/129.15 |
| 5,926,082 | A * | 7/1999 | Coleman et al. | 335/260 |
| 5,927,614 | A * | 7/1999 | Touvelle et al. | 239/585.1 |
| 5,942,169 | A * | 8/1999 | Narazaki et al. | 264/40.1 |

(Continued)

FOREIGN PATENT DOCUMENTS

| | | |
|---|---|---|
| GB | 1406035 | 9/1975 |

*Primary Examiner* — Shawki S Ismail
*Assistant Examiner* — Lisa Homza
(74) *Attorney, Agent, or Firm* — The Ollila Law Group LLC

(57) ABSTRACT

A solenoid (30) is provided. The solenoid (30) includes a magnetic core (304). The solenoid (30) also includes a pole piece (305) positioned substantially coaxially with the magnetic core (304). An over-molded component (303) is provided that is over-molded around at least a portion of the magnetic core (304) and at least a portion of the pole piece (305).

13 Claims, 8 Drawing Sheets

(56) References Cited

U.S. PATENT DOCUMENTS

| | | | | |
|---|---|---|---|---|
| 6,364,084 | B1 * | 4/2002 | Boyer et al. | 192/84.961 |
| 6,565,020 | B1 * | 5/2003 | Fischer et al. | 239/585.1 |
| 6,918,409 | B1 * | 7/2005 | Parker | 137/614.11 |
| 6,927,656 | B2 * | 8/2005 | Iwata et al. | 335/220 |
| 7,571,868 | B2 | 8/2009 | Bayer | |
| 9,052,031 | B2 * | 6/2015 | Leidig | F16K 31/0655 |
| 2002/0130001 | A1 * | 9/2002 | Lisenker | 188/267.2 |
| 2002/0172734 | A1 * | 11/2002 | Stevens | 425/437 |
| 2003/0056984 | A1 * | 3/2003 | Smith et al. | 175/40 |
| 2003/0155445 | A1 | 8/2003 | Mair | |
| 2004/0245863 | A1 * | 12/2004 | Hong et al. | 310/14 |
| 2006/0051451 | A1 * | 3/2006 | Hutchinson et al. | 425/552 |
| 2006/0250031 | A1 * | 11/2006 | Kim | 310/13 |
| 2007/0108668 | A1 * | 5/2007 | Hutchinson et al. | 264/521 |
| 2007/0273462 | A1 * | 11/2007 | Stehle | H01F 7/08<br>335/14 |
| 2007/0289578 | A1 | 12/2007 | Ricco | |
| 2008/0061171 | A1 | 3/2008 | Bayer | |
| 2008/0258353 | A1 * | 10/2008 | Hutchinson et al. | 264/483 |
| 2009/0166506 | A1 * | 7/2009 | Ahmed et al. | 248/634 |
| 2010/0025391 | A1 * | 2/2010 | Palombini et al. | 219/672 |
| 2010/0054971 | A1 * | 3/2010 | Li et al. | 417/423.7 |
| 2010/0054972 | A1 * | 3/2010 | Li et al. | 417/423.7 |
| 2010/0327199 | A1 * | 12/2010 | Linortner | F16K 31/0655<br>251/129.15 |
| 2011/0233799 | A1 * | 9/2011 | Kang | 264/1.38 |
| 2013/0292590 | A1 * | 11/2013 | Stahr | B60T 8/363<br>251/129.15 |

* cited by examiner

SOLENOID WITH AN OVER-MOLDED COMPONENT

TECHNICAL FIELD

The embodiments described below relate to, solenoids, and more particularly, to a solenoid with an over-molded component.

BACKGROUND OF THE INVENTION

Fluid control valves are used in a wide variety of applications to control the flow of a fluid. The fluid being controlled may comprise a gas, a liquid, or a combination thereof. In some situations, the fluid may also include suspended particulates. While fluid control valves vary widely in the specific configuration used to open and close a fluid communication path through the valve, one specific type of valve actuation is performed using a solenoid. In solenoid-actuated valves, an electric current is applied to an electromagnetic coil, with the coil typically positioned around a magnetic core. The coil generally comprises a wire that is wrapped around a plastic bobbin numerous times resulting in a plurality of so-called turns. The energized solenoid generates a magnetic field. The strength of the magnetic flux of the field is proportional to the number of turns as well as the electrical current provided to the wire.

As is well-known in the art, the magnetic flux produced by the energized coil is shaped and directed by the magnetic core and a magnetic pole piece. In some solenoid valves, the pole piece can additionally act as a physical guide for the movable armature. Because the magnetic core and the pole piece direct the magnetic flux, proper positioning of the components results in the most efficient application of the magnetic flux to the movable armature. Ideally, the magnetic core and the pole piece would be positioned in a perfectly coaxial/concentric alignment. As used herein, coaxial and concentric are used interchangeably and are intended to mean that the components being referred to share a common axis or centerline. While "perfect" concentricity may not be practical due to manufacturing tolerances, those skilled in the art can readily appreciate that the more concentric the magnetic core and pole piece are positioned, the more efficiently the magnetic flux can be applied to the movable armature. Additionally, in situations where the pole piece acts as a guide tube for the movable armature, improving concentricity can improve the direction of movement of the movable armature with respect to the magnetic core.

The solenoid's efficiency can be further improved by reducing the air-gap that is made between the movable armature and the pole piece. In situations where the pole piece acts as a guide tube for the movable armature, the air-gap can be decreased by improving the concentricity between the pole piece and the magnetic core. One reason is that as the concentricity between the pole piece and the magnetic core improves, the allowable tolerance between the movable armature and the portion of the magnetic core that receives a portion of the movable armature can decrease, i.e., a larger gap is not necessary to account for a variation away from coaxial alignment.

In some solenoids, a portion of the movable armature is received in a depression formed in the magnetic core. The solenoid's efficiency can be further improved by reducing the air-gap that is made between the movable armature and the walls of the depression. Additionally, the solenoid's efficiency can be further improved by altering the external walls of the depression to adjust the magnetic force versus displacement curves experienced when the solenoid is actuated.

In addition, there is generally a desire to reduce the number of components required to manufacture the valve. One potential reduction of parts is in the seals required to prevent fluid controlled by the valve from reaching the electromagnetic coil.

As a result of the above-mentioned efficiency issues, there have been numerous prior art attempts at increasing the concentricity, decreasing the air-gap, and reducing the number of seals required.

FIG. 1 is a cross-sectional view of a portion of a prior art solenoid valve 10. The prior art solenoid valve 10 is shown and described in greater detail in U.S. Patent Application Publication 2009/0134348. The prior art solenoid valve 10 includes a wire 1 wrapped around a plastic bobbin 2 to form an electromagnetic coil. The prior art solenoid valve 10 further includes a stationary magnetic core 3 and a pole piece 4. The magnetic core 3 and pole piece 4 are inserted into the bobbin 2 and held in place with a plurality of teeth 5 and 6 formed on the core 3 and the pole piece 4, respectively. The teeth 5, 6 partially deform the plastic bobbin 2 upon insertion and prevent the core 3 and pole piece 4 from being easily removed.

Although the prior art solenoid valve 10 eliminates the need for an O-ring to create a fluid-tight seal between the pole piece 4 and the bobbin 2, the prior art solenoid valve 10 is subject to a loss of concentricity between the magnetic core 3 and the pole piece 4, and thus, a movable armature (not shown). This is shown by the longitudinal axis X-X of the magnetic core 3 being offset from the longitudinal axis Y-Y of the pole piece 4. One reason for the unintended offset is that the core 3 and the pole piece 4 are forced into the bobbin 2. Even small variances between the longitudinal axis X-X and the longitudinal axis Y-Y can reduce the magnetic flux aligned to act on the movable armature. The unaligned magnetic flux lowers the efficiency of the valve due to a lower amount of the magnetic flux acting on the movable armature in the direction of the armature's movement. Further, with a portion of the magnetic flux potentially pulling the movable armature at an angle with respect to the armature's movement, frictional forces may increase as the movable armature moves within the pole piece 4.

Furthermore, because concentricity between the magnetic core 3 and the pole piece 4 is compromised, a larger area must be formed in the magnetic core 3 to accommodate the movable armature or a smaller armature needs to be used in order to avoid the movable armature hitting the magnetic core 3. Either case results in a larger air-gap than desired.

FIG. 2 shows a cross-sectional view of another prior art valve 20. The prior art valve 20 includes a housing 21, a wire 22 wrapped around a bobbin 23 to form an electromagnetic coil, a magnetic core 24, a pole piece 25, and a movable armature 26. The prior art valve 20 improves upon the prior art valve 10 by eliminating the need to force the core 24 and pole piece 25 into the bobbin 23 using teeth or other clamping members. Rather, the prior art valve 20 utilizes a weld joint 27 to join the magnetic core 24 and the pole piece 25. The bobbin 23 is then placed over the welded components.

Although the weld joint 27 can improve upon the concentricity between the magnetic core 24 and the pole piece 25, the welding operation can be expensive and time-consuming. Further, in order to provide a suitably small air-gap between the movable armature 26 and the pole piece 25, the weld joint may be required to be ground down to provide a smooth surface, further increasing the time and cost of the assembly.

Therefore, there exists a need in the art for an improved solenoid with an improved concentricity, air-gap, and strength. The solenoid may be incorporated into a valve, an electromagnet, etc. The embodiments described below provide these and other improvements and an advance in the art is achieved. The embodiments described below provide a solenoid with an over-molded component used to hold the magnetic core and the pole piece in place. In some embodiments, the over-molded component comprises a bobbin. The over-molded component is capable of increased manufacturing tolerances that minimize the air-gap between the movable armature and the pole piece, for example.

SUMMARY OF THE INVENTION

A solenoid is provided according to an embodiment. According to an embodiment, the solenoid comprises a magnetic core. The solenoid further comprises a pole piece positioned substantially coaxially with the magnetic core. According to an embodiment, the solenoid further comprises an over-molded component over-molded around at least a portion of the magnetic core and at least a portion of the pole piece.

A method is provided according to an embodiment. The method comprises aligning a magnetic core substantially coaxially with a pole piece. According to an embodiment, the method further comprises over-molding a component around at least a portion of the magnetic core and at least a portion of the pole piece.

ASPECTS

According to an aspect, a solenoid comprises:

a magnetic core;

a pole piece positioned substantially coaxially with the magnetic core; and an over-molded component over-molded around at least a portion of the magnetic core and at least a portion of the pole piece.

Preferably, the solenoid further comprises one or more grooves formed in one or both of the magnetic core and the pole piece for receiving a portion of the over-molded component.

Preferably, the solenoid further comprises a spacing ring located at an interface between the magnetic core and the pole piece.

Preferably, the over-molded component is over-molded around the spacing ring.

Preferably, the solenoid further comprises a movable armature movable within the pole piece between a first position and at least a second position.

Preferably, the movable armature extends into at least a portion of the magnetic core in the second position.

Preferably, the solenoid further comprises one or more grooves formed in the movable armature for communicating a fluid between a first end and a second end of the movable armature.

Preferably, the solenoid further comprises a spacer extending from the magnetic core.

Preferably, the over-molded component comprises a bobbin.

Preferably, the solenoid further comprises a bobbin located around at least a portion of the over-molded component.

According to another aspect, a method comprises:

aligning a magnetic core substantially coaxially with a pole piece; and over-molding a component around at least a portion of the magnetic core and at least a portion of the pole piece.

Preferably, the step of aligning comprises inserting a centering pin through at least a portion of the magnetic core and at least a portion of the pole piece.

Preferably, the method further comprises a step of removing the centering pin after the step of over-molding.

Preferably, the method further comprises a step of positioning a spacing ring at an interface between the magnetic core and the pole piece prior to over-molding the component.

Preferably, the over-molded component comprises a bobbin.

Preferably, the method further comprises a step of positioning a bobbin around at least a portion of the over-molded component.

Preferably, the method further comprises a step of wrapping a wire around the bobbin a plurality of times.

Preferably, the method further comprises positioning the magnetic core, pole piece, over-molded bobbin, and wire within a valve housing of a valve.

Preferably, the method further comprises a step of inserting a movable armature into a least a portion of the pole piece to selectively open a fluid communication path between a first fluid port and a second fluid port of the valve.

DETAILED DESCRIPTION OF THE INVENTION

FIGS. 3*a*-7 and the following description depict specific examples to teach those skilled in the art how to make and use the best mode of embodiments of a solenoid valve. For the purpose of teaching inventive principles, some conventional aspects have been simplified or omitted. Those skilled in the art will appreciate variations from these examples that fall within the scope of the present description. Those skilled in the art will appreciate that the features described below can be combined in various ways to form multiple variations of the solenoid valve. As a result, the embodiments described below are not limited to the specific examples described below, but only by the claims and their equivalents.

Figure 1:
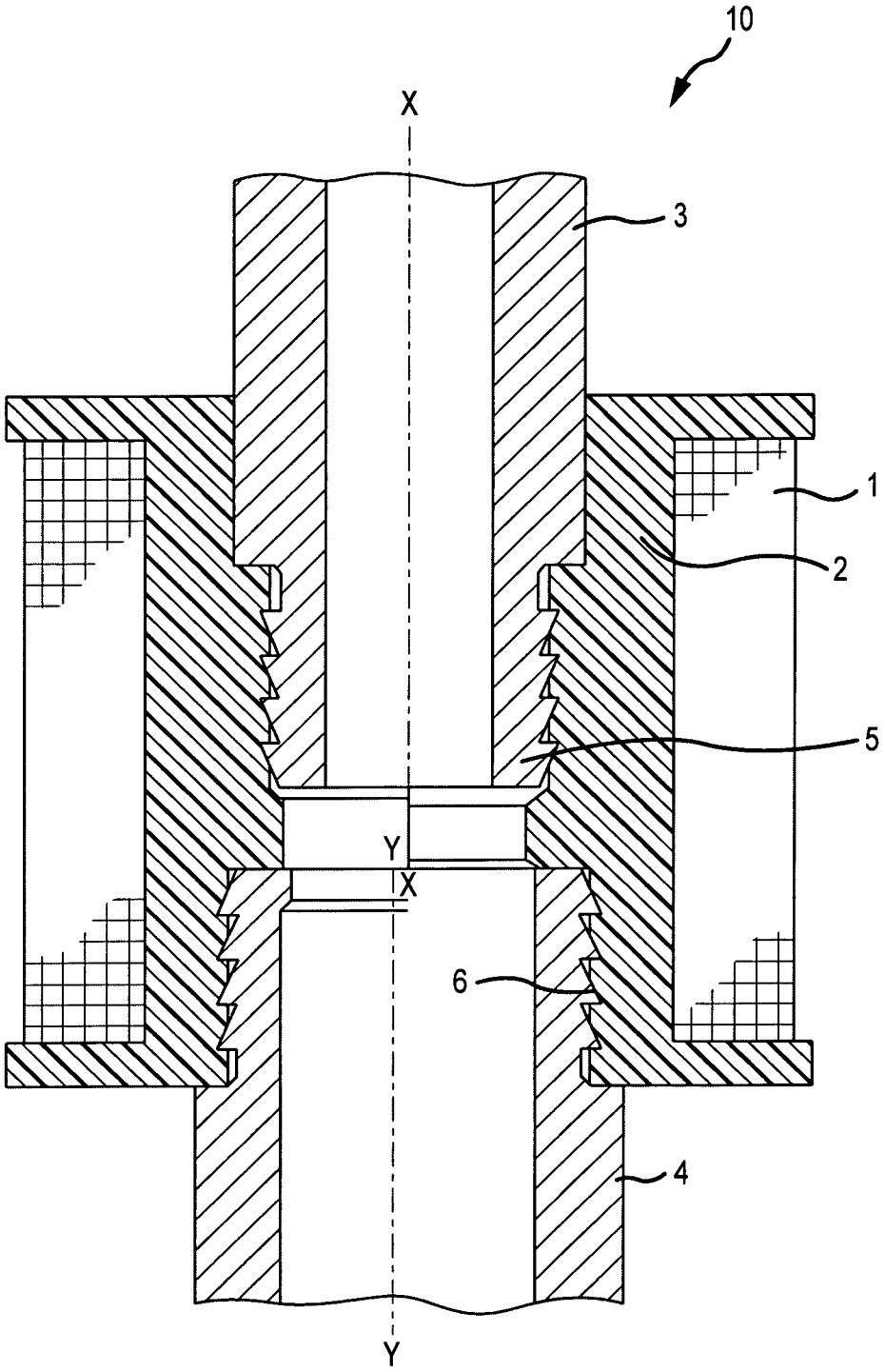
FIG.1 (PRIOR ART)
FIG. 1 shows a cross-sectional view of a portion of a prior art solenoid valve.
Figure 2:
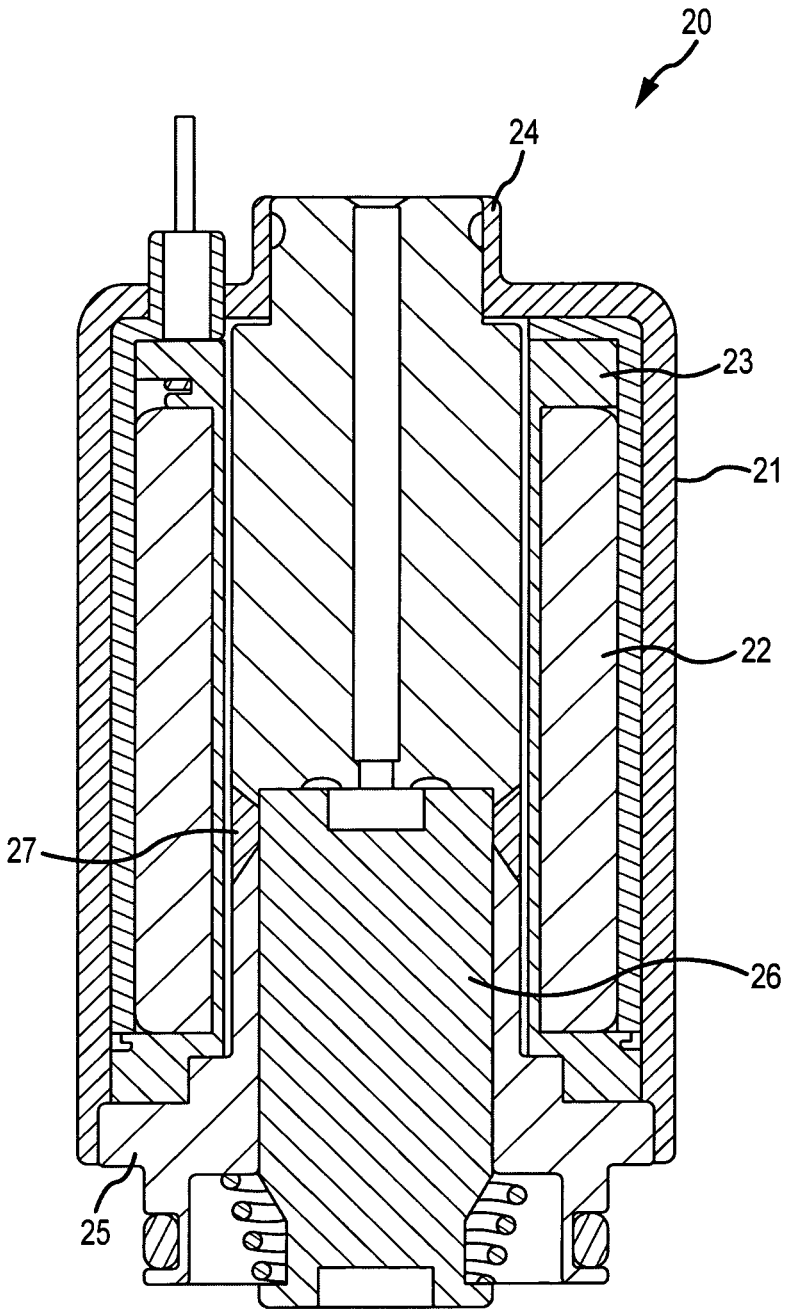
FIG.2 (PRIOR ART)
FIG. 2 shows a cross-sectional view of a prior art solenoid valve.
Figure 3A:
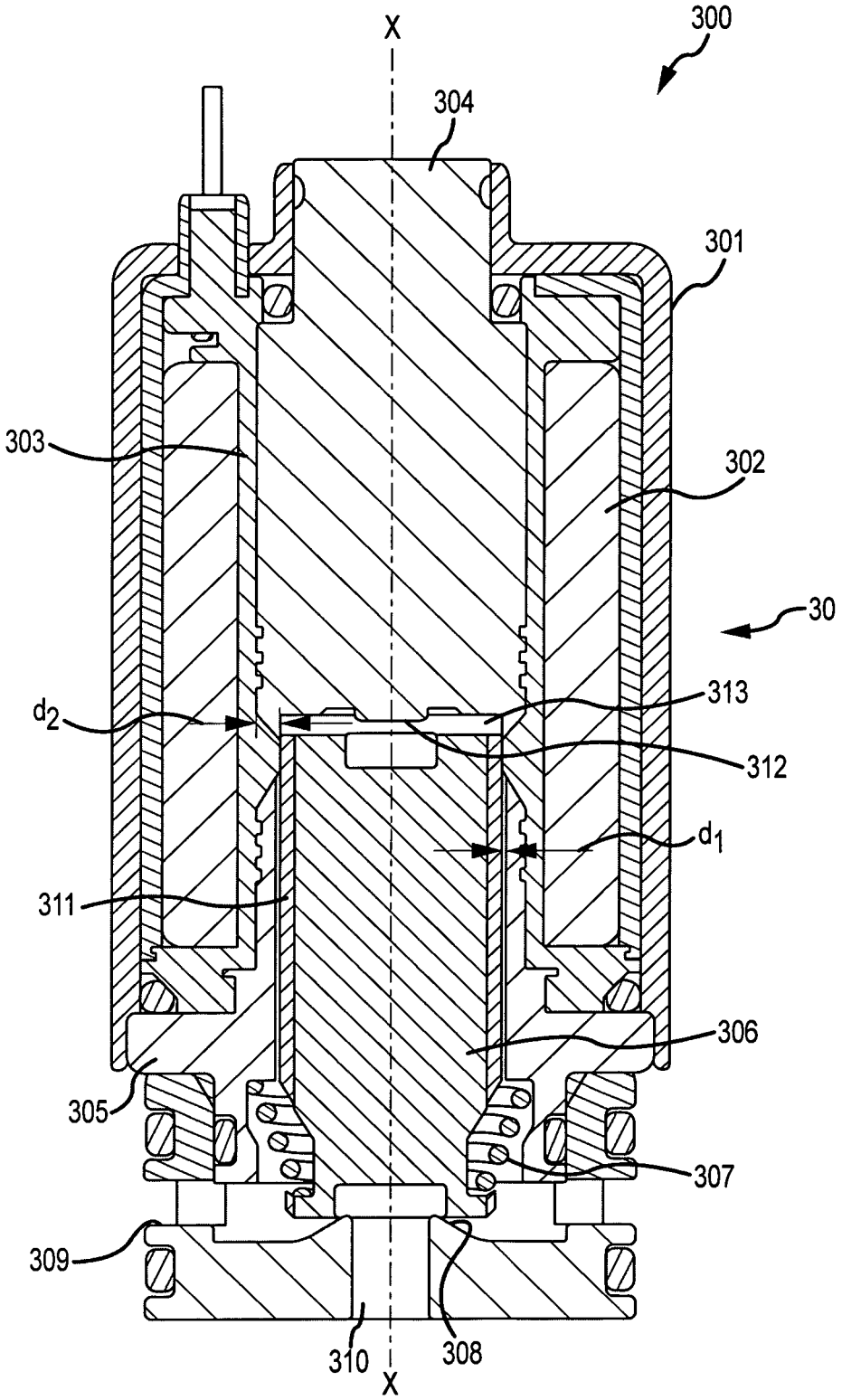
FIG. 3*a* shows a cross-sectional view of a solenoid valve according to an embodiment.

FIG. 3*a* shows a cross-sectional view of a solenoid valve 300 including a solenoid 30 according to an embodiment. Although the solenoid 30 comprises a portion of a valve 300, it should be appreciated that the solenoid 30 could just as easily be incorporated into other devices. For example, the solenoid 30 may be used as an electromagnet to actuate a work piece or the like. Therefore, although a valve is often referred to in order to aid the reader's understanding, the description and claims that follow should in no way be limited to a valve. The valve 300 comprises a housing 301 that encloses the solenoid 30. The solenoid 30 includes a wire 302 wrapped around a an over-molded component 303, which is in the form of a bobbin 303 in FIG. 3*a* to form an electromagnetic coil, a magnetic core 304, a pole piece 305, and a moveable armature 306. According to the embodiment shown, the movable armature 306 can be biased in a first direction by a biasing member 307. The first direction may be towards a valve seat 308 or away from the valve seat 308, i.e., normally closed valve or normally open valve. As can be appreciated, when assembled, the movable armature 306 can selectively open a fluid communication path between a first fluid port 309 and a second fluid port 310.

According to an embodiment, an electrical current can be supplied to the wire 302 in order to actuate the valve 300. Once the magnetic flux acting on the movable armature 306 exceeds the biasing force of the biasing member 307 along with or without any fluid force, the movable armature 306 will be actuated.

Once the movable armature 306 is moved away from the valve seat 308, fluid can flow between the first and second fluid ports 309, 310. In some embodiments, the movable armature 306 may include one or more grooves 311 that extend approximately parallel to a longitudinal axis of the movable armature 306. The one or more grooves 311 can provide a fluid path to the end of the movable armature 306 opposite the valve seat 308 in order to provide a pressure balanced armature. Consequently, fluid pressure can act on both ends of the movable armature 306 to at least partially balance the fluid forces acting on the movable armature 306. In order to allow fluid to freely reach the end of the movable armature 306, a spacer 312 can be provided. The spacer 312 can be coupled to the magnetic core 304, for example. In other embodiments, the spacer 312 may comprise a portion of the magnetic core 304. According to yet another embodiment, the spacer 312 may be coupled to the movable armature 306. According to an embodiment, the spacer 312 may be formed from a non-magnetic material in order to avoid magnetic sticking of the movable armature 306 after electrical energy is removed from the coil.

As mentioned above, the magnetic force applied on the movable armature 306 will be maximized when the magnetic field is properly aligned with respect to the longitudinal axis of the movable armature 306, and thus, the movement of the movable armature 306.

According to an embodiment, the pole piece 305 acts as a guide for the movable armature 306 with the movable armature 306 sliding within the pole piece 305. Consequently, in order to properly align the magnetic force acting on the movable armature 306, concentricity between the magnetic core 304 and the pole piece 305 should be maximized. As explained above, while certain manufacturing tolerances may not permit perfectly concentric alignment of the magnetic core 304 and the pole piece 305, the magnetic force acting on the movable armature 306 can be improved as perfect concentric alignment is approached. As shown, the magnetic core 304 and the pole piece 305 are shaped generally as tubes. Therefore, in order to maintain concentricity between the two components, the radial centers of the two components should be properly aligned along the same longitudinal axis, in this case, the longitudinal axis, X-X of the valve 300. As shown, the valve 300 improves upon the valve 10 in that the magnetic core 304 and the pole piece 305 are coaxially aligned along the longitudinal axis X-X of the valve 300. When the magnetic core 304 and the pole piece 305 are coaxially aligned, the magnetic force acting on the movable armature 306 can be maximized for a given electrical current and number of coil turns.

As an example, with the magnetic core 304 and the pole piece 305 being coaxially aligned, the air gap between the movable armature 306 and the pole piece 305 can be minimized. For example, an air gap $d_1$ is shown between the pole piece 305 and the movable armature 306. In one tested embodiment, an air gap of approximately 0.025 mm has been achieved. However, this should in no way limit the scope of the present embodiment. In addition to the reduced air gap $d_1$ between the pole piece 305 and the movable armature 306, with coaxially aligned components, a reduced air gap $d_2$ can be achieved between the movable armature 306 and a depression 313 in the magnetic core 304. In some embodiments, the air gap $d_2$ may be approximately the same as the air gap $d_1$ or may be different. A relatively small and consistent air gap is achievable between the movable armature 306 and the depression 313 in the magnetic core 304 due to the coaxial alignment of the pole piece 305, which guides the movable armature 306, and the magnetic core 304. This is in contrast to a prior art solenoid 60, which is shown in FIG. 3*b*.

Figure 3B:
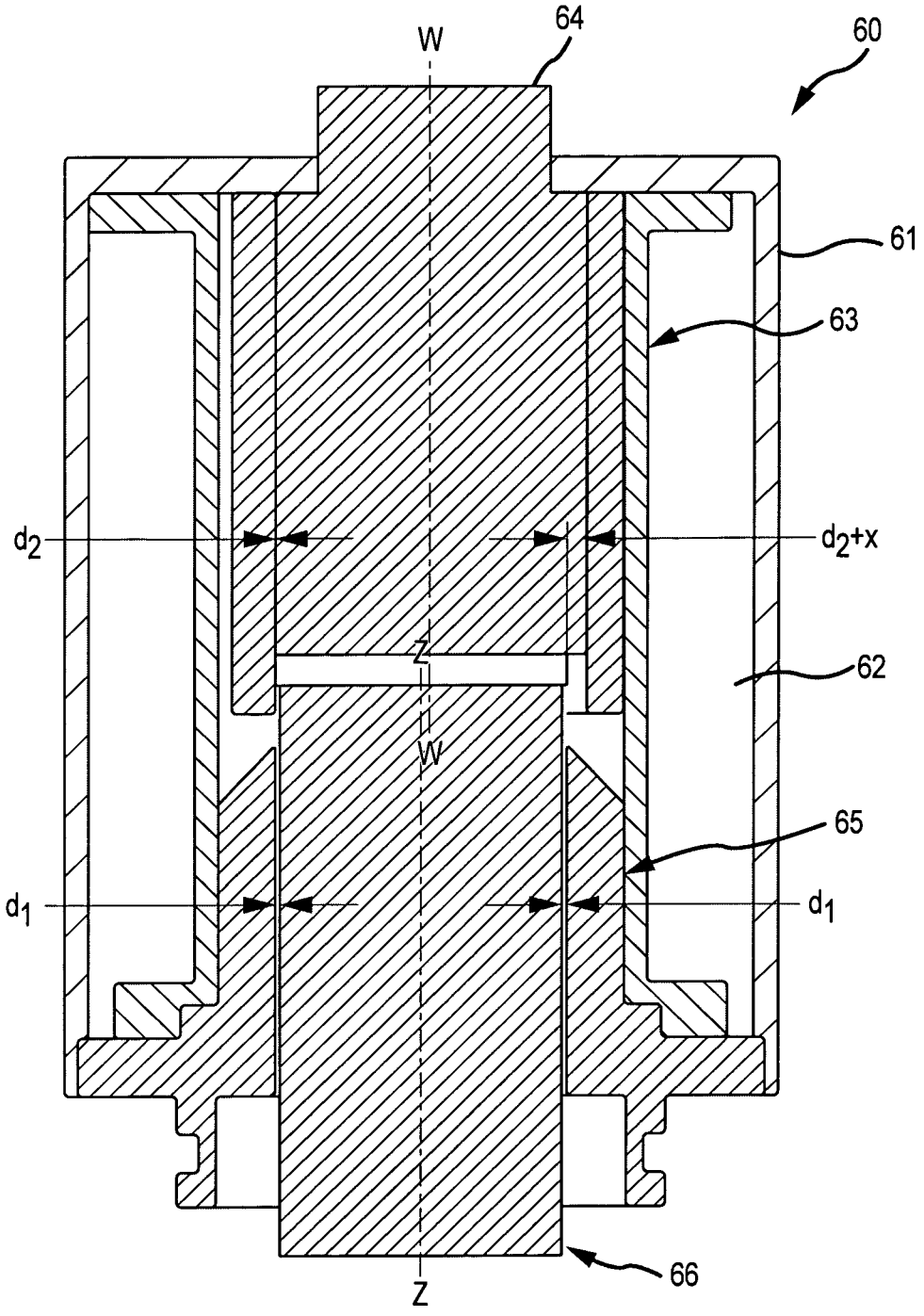
FIG.3B (PRIOR ART)
FIG. 3*b* shows a cross-sectional view of a prior art solenoid valve.

FIG. 3*b* shows a cross-sectional view of a prior art solenoid 60. The solenoid 60 comprises a housing 61, a wire 62 wrapped around a bobbin 63 to form an electromagnetic coil, a magnetic core 64, a pole piece 65, and a moveable armature 66. As shown, unlike the solenoid 30 that comprises a coaxially aligned magnetic core and pole piece, resulting in the movable armature also being coaxially aligned, the magnetic core 64 and the pole piece 65 are not coaxially aligned. The magnetic core 64 comprises a longitudinal axis W-W, which is shown slightly offset from the longitudinal axis Z-Z of the pole piece 65. The air gap between the movable armature 66 and the pole piece 65 may still comprise a gap of $d_1$, which may be the same as the gap $d_1$ of the embodiment shown in FIG. 3*a*. However, the air gap between the movable armature 66 and the magnetic core 64 is inconsistent. Because of the offset longitudinal axes W-W and Z-Z, a first side of the solenoid 60 may comprise the air gap $d_2$. However, a second side of the solenoid 60 may comprise an air gap of $d_2+x$. The increased air gap $d_2+x$ is due to the offset longitudinal axes. Consequently, the solenoid 60 is not capable of precise control. While the solenoid 30 may be capable of achieving proportional control due to the small air gap, proportional control of the solenoid 60 is much more difficult. In other words, while an accurate control of the force applied to the movable armature 306 as a function of the armature's stroke is possible with the small air gaps $d_1$ and $d_2$, an accurate control of the force applied to the movable armature 66 as a function of the armature's stroke is not possible with the larger air gap of $d_2+x$.

Figure 4A:
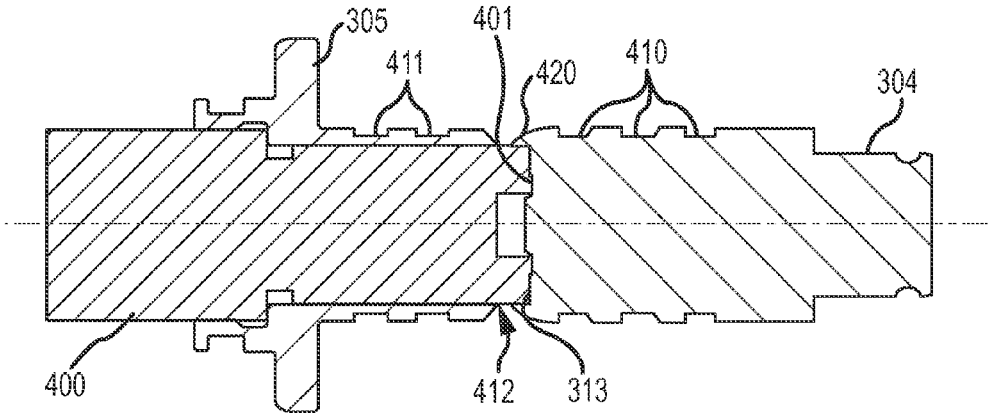
FIG. 4*a* shows a magnetic core and a pole piece held together by a centering pin according to an embodiment.
Figure 4B:
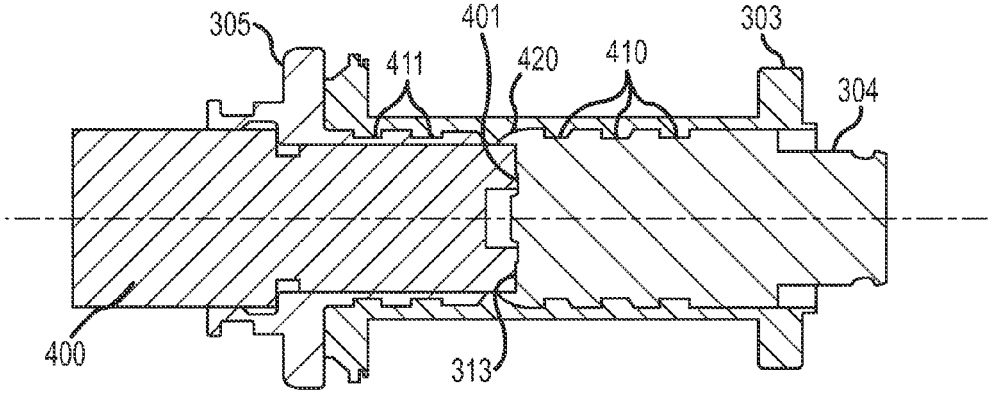
FIG. 4*b* shows the magnetic core, pole piece, and centering pin after a bobbin has been over-molded around the components according to an embodiment.
Figure 4C:
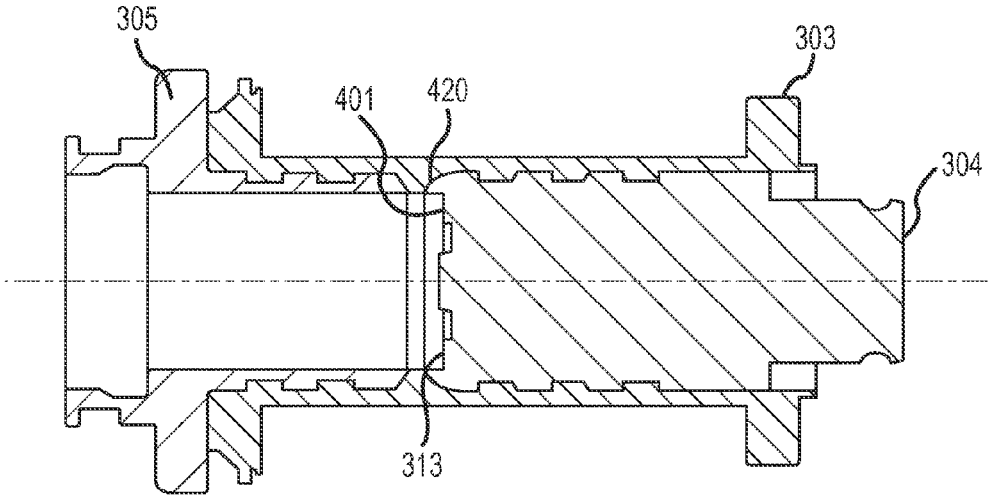
FIG. 4*c* shows the magnetic core, pole piece, and over-molded bobbin after the centering pin has been removed according to an embodiment.

According to an embodiment, concentricity is improved compared to the prior art by over-molding a component 303 around the magnetic core 304 and the pole piece 305. In some of the embodiments, described below, the over-molded component comprises a bobbin 303. However, in other embodiments, the over-molded component 303 can comprise a sleeve with a separate bobbin 703 positioned around at least a portion of the over-molded component 303 (See FIG. 7). FIGS. 4*a*-4*c* illustrates a simplified version of the process.

FIG. 4*a* shows a centering pin 400 inserted into a portion of the pole piece 305 as well as the magnetic core 304. The centering pin 400 may include one or more alignment tabs 401, which can engage a portion of the magnetic core 304, the pole piece 305 or both. The centering pin 400 can temporarily engage the magnetic core 304 and the pole piece 305 in order to align their longitudinal axes along a common axis. In other words, the centering pin 400 can ensure the magnetic core 304 and the pole piece 305 are coaxially aligned. The centering pin 400 may engage the components by simply being inserted into a portion of the magnetic core 304 and the pole piece 305. Alternatively, the centering pin 400 may engage the components in a snap-fit type arrangement. The particular type of engagement is not important as long as the centering pin 400 is able to align the longitudinal axes of the magnetic core 304 and the pole piece 305.

Although the centering pin 400 is shown as extending through only a portion of the magnetic core 304, in other embodiments, the centering pin 400 can extend entirely through the magnetic core 304. The magnetic core 304 may therefore, include a small aperture extending through at least a portion of the length of the magnetic core 304 to accommodate a portion of the centering pin 400. In preferred embodiments, the entire diameter of the centering pin 400 shown in the figures would not extend through the magnetic core 304 because the magnetic core 304 would consequently require a large open space. This open space would lower the effectiveness of the magnetic core 304. Rather, a portion of the centering pin 400 having a smaller diameter could be provided.

With the magnetic core 304 and pole piece 305 properly aligned by the centering pin 400, the three components can be inserted into an appropriate mold (not shown) and the coil bobbin 303 can be over-molded around at least a portion of the three components. The over-molding operation can be conducted by injection molding, for example. The specific details relating to the molding process are omitted for brevity of the description. Over-molding is a well-known technique used in a variety of industries. Therefore, those skilled in the art will readily recognize a suitable molding process and molding machine.

As those skilled in the art will readily recognize, in order to accommodate the over-molding process, the magnetic core 304 and the pole piece 305 will need to have a higher melting temperature than the plastic used to form the bobbin 303. This is typically not a problem as the metals used to form the magnetic core 304 and the pole piece 305 generally have a higher melting temperature than the plastic bobbin 303. Therefore, the injected plastic will generally not melt the magnetic core 304 or the pole piece 305 during the over-molding process.

Over-molding the bobbin 303 around the magnetic core 304 and the pole piece 305 provides a number of advantages. Over-molding results in molecular adhesion between the substrate materials (the magnetic core 304 and the pole piece 305) and the over-molded material (the bobbin 303). Therefore, once the bobbin 303 cools and solidifies, the magnetic core 304 and pole piece 305 are maintained in their proper coaxial positions by the bobbin 303. Additionally, the molecular adhesion results in a substantially fluid-tight seal between the magnetic core and the bobbin 303 as well as between the pole piece 305 and the bobbin 303. Advantageously, O-ring seals can be eliminated between these components.

FIG. 4*b* shows the bobbin 303, the magnetic core 304, the pole piece 305, and centering pin 400 after being removed from the mold (not shown). As can be seen, the bobbin 303 is over-molded around at least a portion of the magnetic core 304 and the pole piece 305. A portion of each of the magnetic core 304 and the pole piece 305 extends axially beyond the bobbin 303. According to an embodiment, the magnetic core 304 can include one or more grooves 410 formed on the outer surface. Likewise, the pole piece 305 can include one or more grooves 411 formed on the outer surface. Additionally, a space 412 is formed between the magnetic core 304 and the pole piece 305. As shown in FIG. 4*b*, the grooves 410, 411 as well as the space 412 provide areas for the plastic injected to form the bobbin 303 to flow into to provide a mechanical interlock engagement, which can assist the molecular adhesion in holding the components in place.

According to an embodiment, once the over-molded bobbin 303 cools, the centering pin 400 can be removed as shown in FIG. 4*c*. According to an embodiment, the wire coil 302 can be wrapped around the bobbin 303 and the three components can then be positioned within the housing 301. As can be seen in FIG. 3, the movable armature 306 can occupy the space previously occupied by the centering pin 400.

As can be appreciated, the over-molded bobbin 303 can improve the concentricity between the magnetic core 304 and the pole piece 305 because the bobbin 303 is molded while the magnetic core 304 and the pole piece 305 are substantially coaxially aligned with the centering pin 400. According to one embodiment, the centering pin 400 is capable of aligning the magnetic core 304 and the pole piece 305 to within 1/100mm of the desired position. This type of precision is currently unavailable in the prior art at a low cost. Further, the over-molded bobbin 303 can reduce the required air-gap between the movable armature 306 and the pole piece 305. This is because, the pole piece 305 is not physically deformed as in the prior art where the pole piece is physically forced into the bobbin. Therefore, less space is required to accommodate a potentially offset alignment. The increased alignment also allows for a reduced air-gap between the movable armature 306 and the magnetic core 304, as mentioned above. The reduced air-gap can improve control over the magnetic force provided to the movable armature 306 throughout a displacement range of the movable armature 306 as the movable armature 306 is partially received in the depression 313. The force provided to the movable armature 306 can be further adjusted by changing the shape of the wall 420 of the depression 313. For example, while the wall 420 is shown tapering towards the end, other configurations can provide different responses. Therefore, the particular configuration shown should not limit the scope of the description and claims.

Figure 5:
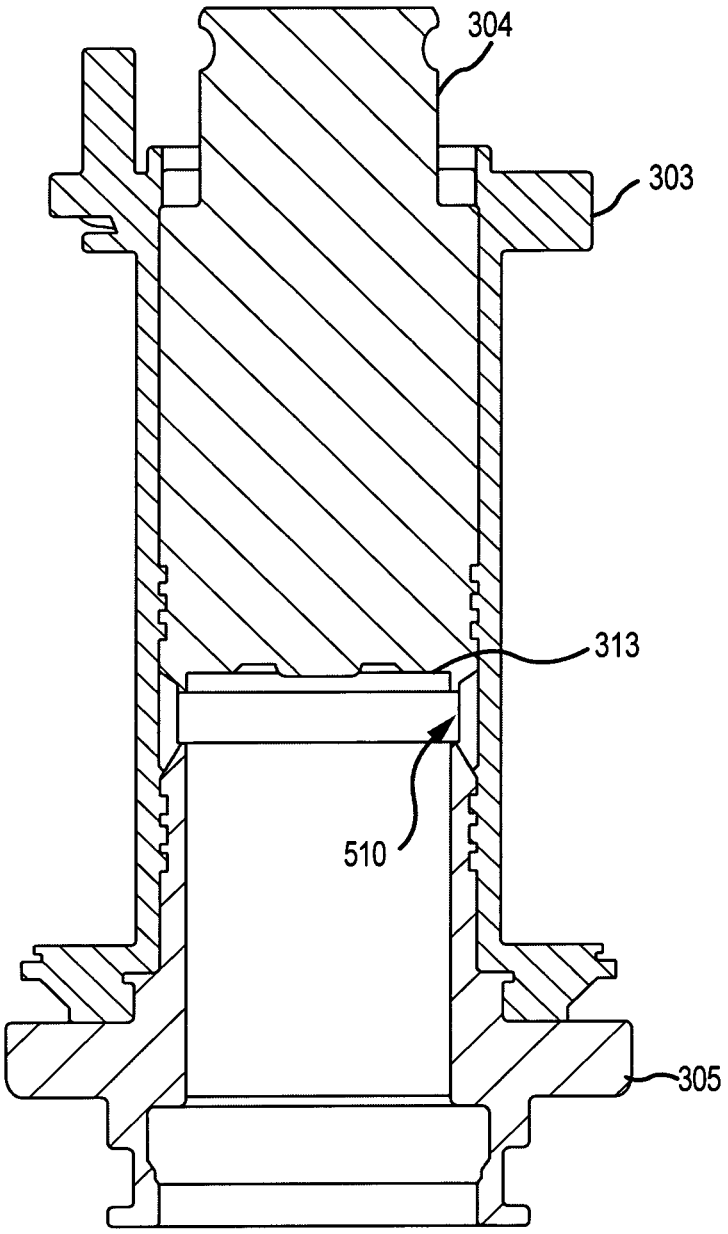
FIG. 5 shows a cross-sectional view of a portion of the solenoid valve according to another embodiment.

FIG. 5 shows the bobbin 303, the magnetic core 304, and the pole piece 305 according to another embodiment. In the embodiment shown in FIG. 5, a spacing ring 510 is additionally provided. The spacing ring 510 can be positioned at an interface between the magnetic core 304 and the pole piece 305 during the over-molding process. According to an embodiment, the spacing ring 510 can aid the centering pin 400 in aligning the magnetic core 304 and the pole piece 305. According to an embodiment, the spacing ring 510 can also prevent the injected plastic used to form the bobbin 303 from entering the interior space of the pole piece 305 during the molding process. As shown in FIGS. 4*a*-4*c*, there is a small space 412 where the injected bobbin 303 can enter between the magnetic core 304 and the pole piece 305, which may result in plastic being left within the pole piece 305 once the centering pin 400 is removed. However, with the spacing ring 510 in place, the injected plastic is substantially prevented from entering the interior of the pole piece 305.

Figure 6:
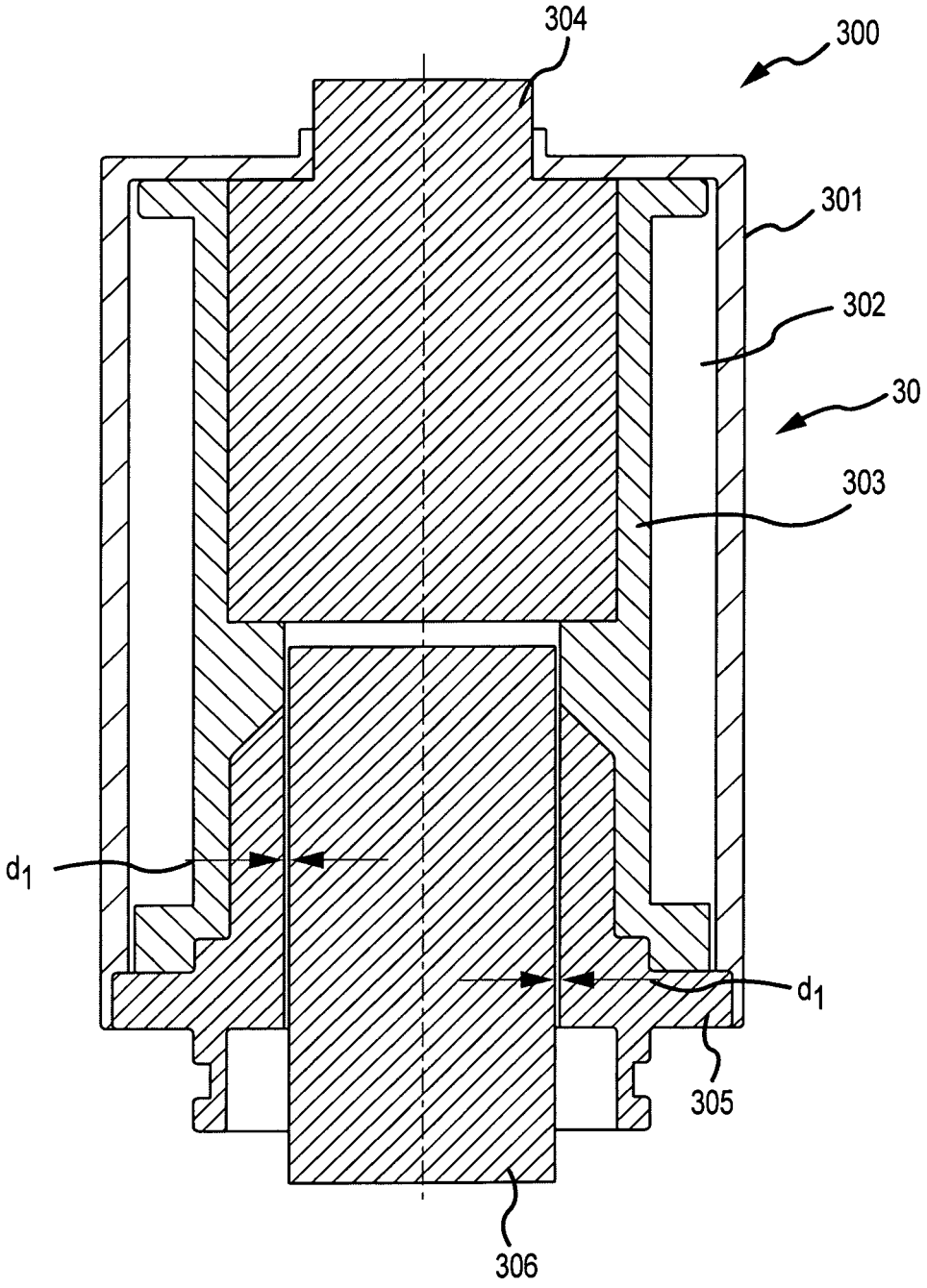
FIG. 6 shows a cross-sectional view of the solenoid valve according to another embodiment.

FIG. 6 shows a cross-sectional view of the solenoid 30 according to another embodiment. While the previous embodiments show the magnetic core 304 including the depression 313 to receive a portion of the movable armature 306, the embodiment shown in FIG. 6 does not include the depression 313. Rather, during use the movable armature 306 can simply abut the end of the magnetic core 304. It should be appreciated that the concentricity of the components is still achievable due to the over-molded bobbin 303. However, without the depression 313, proportional control of the movable armature may be reduced compared to the previously described embodiments.

Figure 7:
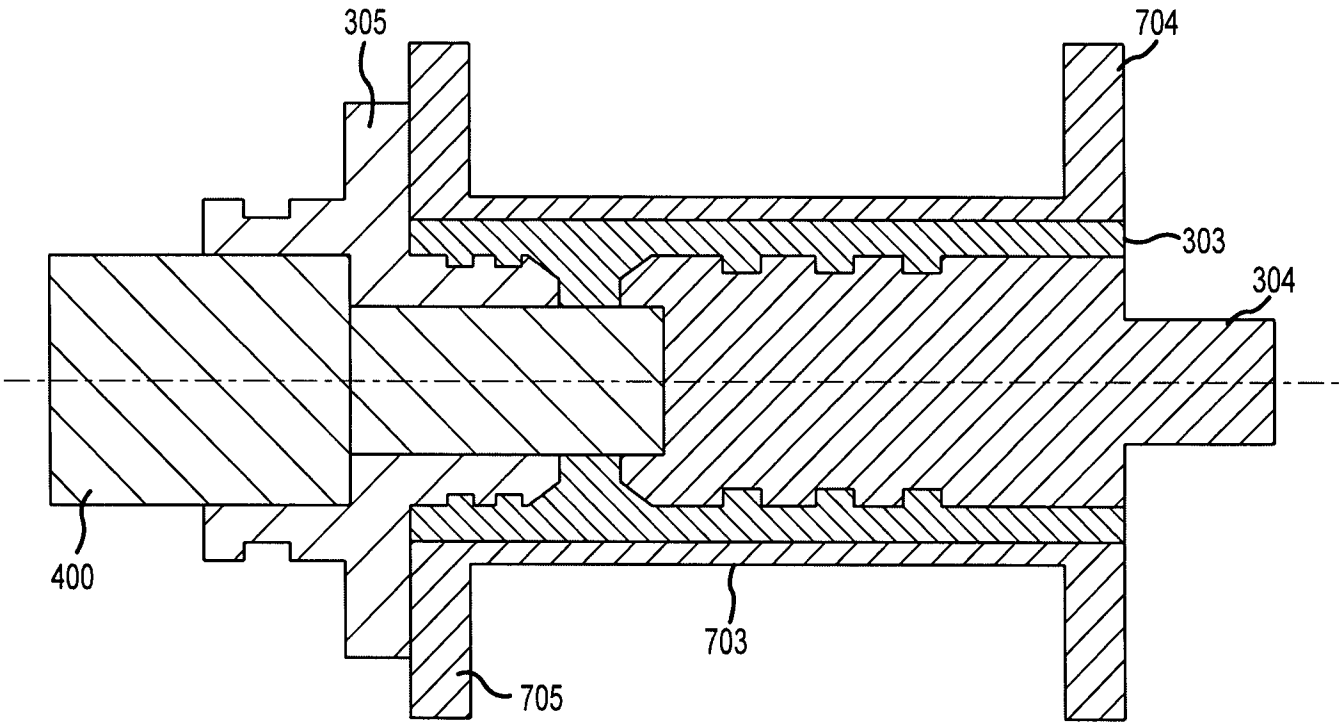
FIG. 7 shows a cross-sectional view of the magnetic core, pole piece, and over-molded component with a bobbin positioned around the over-molded component.

FIG. 7 shows a cross-sectional view of the over-molded component 303, the magnetic core 304, the pole piece 305, the centering pin 400, and a separate bobbin 703 after being removed from the mold (not shown). In the embodiment shown in FIG. 7, the over-molded component 303 is in the shape of a sleeve without flanges to hold the wire. Therefore, while the over-molded component 303 still maintains concentricity between the magnetic core 304 and the pole piece 305, a separate bobbin 703, with flanges 704, 705, is required to hold the wire 302 in place. According to one embodiment, the bobbin 703 may be inserted into the mold (not shown) and the over-molded component 303 can be injected between the bobbin 703 and the magnetic core 304 and pole piece 305. This process results in a bond between the over-molded component 303 and the bobbin 703 in addition to the bond between the magnetic core 304, pole piece 305, and over-molded component 303 discussed previously.

As an alternative, the over-molded component 303 may be over-molded, and once removed from the mold, the bobbin 703 can be pressed over at least a portion of the over-molded component 303. The bobbin 703 can then be held in place via friction fit, adhesives, mechanical fasteners, etc. In either situation, the over-molded component 303 can maintain concentricity between the magnetic core 304 and the pole piece 305 as in the previously shown embodiments.

The embodiments described above provide an improved solenoid. The solenoid may be incorporated into a valve or some other electromagnet that acts on a work piece. The solenoid in the embodiments described above improves the solenoid's efficiency by more accurately aligning and maintaining the magnetic core and the pole piece along a common axis. The improved accuracy is attributable to the over-molded component that holds the components in place while also providing a substantially fluid-tight seal. Therefore, the embodiments described above also eliminates one or more seals that are seen in the prior art.

The detailed descriptions of the above embodiments are not exhaustive descriptions of all embodiments contemplated by the inventors to be within the scope of the present description. Indeed, persons skilled in the art will recognize that certain elements of the above-described embodiments may variously be combined or eliminated to create further embodiments, and such further embodiments fall within the scope and teachings of the present description. It will also be apparent to those of ordinary skill in the art that the above-described embodiments may be combined in whole or in part to create additional embodiments within the scope and teachings of the present description.

Thus, although specific embodiments are described herein for illustrative purposes, various equivalent modifications are possible within the scope of the present description, as those skilled in the relevant art will recognize. The teachings provided herein can be applied to other valves, and not just to the embodiments described above and shown in the accompanying figures. Accordingly, the scope of the embodiments described above should be determined from the following claims.

We claim:

1. A solenoid (30), comprising:

a magnetic core (304);

a pole piece (305) positioned substantially coaxially with the magnetic core (304) wherein the pole piece is a separate element from the magnetic core;

a movable armature (306) movable within the pole piece (305) between a first position and at least a second position;

a longitudinal groove (311) defined by the movable armature;

a gap (d1) between the pole piece (305) and the movable armature (306) proximate a length of the longitudinal groove (311); and an over-molded component (303) over-molded around at least a portion of the magnetic core (304) and at least a portion of the pole piece (305), wherein the over-molded component comprises a bobbin, and is further adapted to coaxially align and connect the magnetic core (304) and the pole piece (305) in a coaxial orientation.

2. The solenoid (30) of claim 1, further comprising one or more grooves (410, 411) formed in one or both of the magnetic core (304) and the pole piece (305) for receiving a portion of the over-molded component (303).

3. The solenoid (30) of claim 1, further comprising a spacing ring (510) located at an interface between the magnetic core (304) and the pole piece (305).

4. The solenoid (30) of claim 3, wherein the over-molded component (303) is over-molded around the spacing ring (510).

5. The solenoid (30) of claim 1, wherein the movable armature (306) extends into at least a portion (313) of the magnetic core (304) in the second position.

6. The solenoid (30) of claim 1, further comprising one or more grooves (311) that are a part of and wholly defined by the movable armature (306) for communicating a fluid between a first end and a second end of the movable armature (306).

7. The solenoid (30) of claim 1, further comprising a protrusion (312) extending from and defined by the magnetic core (304).

8. The solenoid (30) of claim 1, wherein the over-molded component (303) comprises a bobbin.

9. The solenoid (30) of claim 1, further comprising a bobbin (703) located around at least a portion of the over-molded component (303).

10. A solenoid (30), comprising:

a magnetic core (304);

a pole piece (305) positioned substantially coaxially with the magnetic core (304), wherein the pole piece is a separate element from the magnetic core;

a movable armature (306) movable within the pole piece (305) between a first position and at least a second position;

a longitudinal groove (311) defined by the movable armature (306);

a gap (d1) between the pole piece (305) and the movable armature (306) proximate a length of the longitudinal groove (311);

an over-molded component (303) overmolded around at least a portion of the magnetic core (304) and at least a portion of the pole piece (305) wherein the over-molded component is adapted to coaxially align and connect the magnetic core (304) and the pole piece (305) in a coaxial position, wherein the over-molded component further comprises a bobbin;

a plurality of grooves defined by the magnetic core (304) configured to secure the over-molded component (303) thereto; and a plurality of grooves defined by the pole piece (305) configured to secure the over-molded component (303) thereto.

11. The solenoid (30) of claim 10, further comprising one or more grooves (410, 411) formed in one or both of the magnetic core (304) and the pole piece (305) for receiving a portion of the over-molded component (303).

12. The solenoid (30) of claim 10, further comprising one or more grooves (311) that are a part of and wholly defined by the movable armature (306) for communicating a fluid between a first end and a second end of the movable armature (306).

13. The solenoid (30) of claim 10, further comprising a protrusion (312) extending from and defined by the magnetic core (304).

* * * * *